United States Patent [19]

Peignier et al.

[11] 4,378,968

[45] Apr. 5, 1983

[54] PROCESS FOR PREVENTING THE REDEPOSITION OF SOIL DURING DRY CLEANING, AND COMPOSITION FOR CARRYING OUT THIS PROCESS

[75] Inventors: Michel Peignier, Versallies; Claude Renault, Saint-Remy-Les Chevreuse, both of France

[73] Assignee: Chloe Chimie, Puteaux, France

[21] Appl. No.: 274,546

[22] Filed: Jun. 17, 1981

[30] Foreign Application Priority Data

Jun. 20, 1980 [FR] France ..... 80 13700

[51] Int. Cl.[3] ..... D06L 1/02; D06L 1/10; C11D 3/44

[52] U.S. Cl. ..... 8/142; 252/171; 252/173; 570/118

[58] Field of Search ..... 8/142; 252/171, 173; 570/118

[56] References Cited

U.S. PATENT DOCUMENTS

| | | | |
|---|---|---|---|
| 3,630,935 | 12/1971 | Potter | 8/142 |
| 3,642,644 | 2/1972 | Grote et al. | 8/142 |
| 3,682,834 | 8/1972 | Vivian | 252/171 |
| 3,701,627 | 10/1972 | Grunewalder | 252/171 |
| 3,872,021 | 3/1975 | McKnight | 252/173 |
| 4,023,984 | 5/1977 | Clementson et al. | 252/171 |
| 4,227,883 | 10/1980 | Peignier et al. | 252/171 |

FOREIGN PATENT DOCUMENTS

| | | | |
|---|---|---|---|
| 42-21803 | 10/1967 | Japan | 570/118 |

OTHER PUBLICATIONS

Raviprasad et al., Jour. Chem. Eng. Data, vol. 26, pp. 211-213 (Apr. 1981).

*Primary Examiner*—Maria Parrish Tungol
*Attorney, Agent, or Firm*—McDougal, Hersh & Scott

[57] ABSTRACT

Process for preventing soil redeposition onto textile articles made of natural, synthetic or artificial fibers or a blend thereof, during dry cleaning operations using stabilized perchloroethylene.

It is characterized in that a sufficient amount of at least one $C_4$ to $C_6$ alcohol, chosen from amongst those having a boiling point of between 95° and 140° C. and those forming, with the perchloroethylene, an azeotrope having a boiling point of between 80° and 130° C., is incorporated into this perchloroethylene.

9 Claims, No Drawings

PROCESS FOR PREVENTING THE REDEPOSITION OF SOIL DURING DRY CLEANING, AND COMPOSITION FOR CARRYING OUT THIS PROCESS

The present invention relates to a process for preventing soil redeposition onto textile articles, with the object of preventing soil from redepositing onto a substrate made of natural, artificial or synthetic fibers or a blend of these same fibers, and thus of keeping the soil from this substrate in suspension in the liquid bath during dry cleaning.

The invention also relates to an anti-redeposition composition based on perchloroethylene, for the dry cleaning of textiles, with the object of preventing soil from a substrate from redepositing onto this substrate.

It is well known that, during operations for the dry cleaning of woven or knitted textiles using perchloroethylene, the soil extracted from the textiles tends to redeposit onto these same textiles, especially if the perchloroethylene is not regenerated regularly, and this accentuates the phenomenon of "greying" of the textiles, which is more readily observed on white or light-colored fabrics.

The factors which can affect this redeposition are numerous and the complexity of the phenomenon depends mainly on the diverse nature of the fibers used in the same cleaning bath, and on the relative humidity of the ambient atmosphere.

Various anti-redeposition agents have already been proposed for washing textiles in an aqueous medium, in particular cellulose derivatives.

In the case of cleaning in an organic solvent medium, it is known that certain boosters have an anti-redeposition action, in particular the substituted oxazines and amides, having more than 10 carbon atoms, described in French Pat. No. 1,386,783 and its addition No. 89,341. However, these boosters exhibit the major disadvantage that they cannot be distilled, and they must therefore be freshly added after each operation for regenerating the dirty solvent.

It is an object of this invention to provide a technique which makes it possible to avoid redeposition and thus very considerably to limit the "greying" phenomenon during the dry cleaning of textiles made of synthetic, artificial, natural or blended fibers. A further object of this invention resides in the development of a technique which makes it possible to recover and re-use the anti-redeposition agent each time the bath is regenerated. The invention also has for its object a technique which prevents the loss of anti-redeposition agent through entrainment by the water introduced by the textiles and/or the customary additives, and a technique which makes it possible to reduce the concentration of anti-redeposition additive at the start of the drying stage, and consequently to eliminate the explosion hazards. Further advantages will become apparent on reading the account which follows.

It has been found that the above-mentioned objectives can be achieved by using certain primary or secondary alcohols in the suitably stabilized perchloroethylene.

More precisely, the invention relates to a process for preventing soil redeposition during dry cleaning with the aid of suitably stabilized perchloroethylene, which process is characterized in that, in order to observe the desired effect of limiting the phenomenon of "greying" of the textiles, a sufficient amount of at least one primary or secondary alcohol of the formula ROH, in which R represents an alkyl or alkenyl radical containing from 4 to 6 carbon atoms, is added to the stabilized perchloroethylene and/or to the dry cleaning bath, the said alcohol having a boiling point of between 95° and 140° and/or forming, with the perchloroethylene, and azeotrope having a boiling point of between 80° and 130° C.

The desired anti-redeposition effect only becomes discernible when alcohol is added to the perchloroethylene in an amount of at least 0.5% by weight, is appreciable above about 1% by weight and is generally optimum at a concentration ranging up to 10% by weight and preferably from 1.5 to 5% by weight.

The perchloroethylene can be stabilized by any appropriate stabilizing agent, in particular those compatible with the presence of the alcohols defined above, such as, inter alia: butylene oxide, triethylamine, tert.-butanol, N-methylpyrrole, diisobutylene, isopropyl acetate and epichlorohydrin, taken separately or as a mixture of at least two of these compounds, without this list of components implying a limitation.

The process for preventing redeposition, according to the invention, can also include the addition of products commonly employed in dry cleaning, such as, for example, cleaning boosters represented by anionic, cationic or non-ionic surface-active agents such as: alkylsulphonates, alkylarylsulphonates, more particularly calcium dodecylbenzenesulphonate, oxyethyleneation products of fatty alcohols, petroleum sulphonates, alkyl polyglycol ethers, alkylphenol polyglycol ethers, more particularly oxyethyleneated nonylphenol containing 12 mols of ethylene oxide, brighteners, finishing agents, anti-static agents and water repellants. Each of these additives can be employed in the usual proportions, for example of 1 to 10 g per liter of bath, insofar as it is compatible with the presence of the alcohols of the invention, as defined above.

Moreover, the process of the invention can include the addition of water in a proportion which can range up to about 5–6%, and more particularly from 2 to 3%, by weight, relative to the textiles to be cleaned. This water can originate from the moisture introduced by the textiles themselves and/or by the commercial cleaning boosters, which contain between 4 and 30% and usually from 8 to 14% of their weight of water. Sometimes, additional amounts of water (about 2 to 4% by weight, relative to the textiles to be cleaned) are added to the cleaning bath containing the boosters, in order to improve the cleaning effect with respect to the so-called "lean" stains.

The invention also relates to a composition or a bath which is useful, in the dry cleaning of textiles, for preventing "greying" or soil redeposition onto textiles based on natural, artificial or synthetic fibers or blends of these fibers, during the actual dry cleaning operations using suitably stabilized perchloroethylene optionally containing up to 6% by weight of water, relative to the textiles to be treated, and customary additives, more particularly cleaning boosters and anti-static agents, it being possible for each of these additives to be present in an amount of 1 to 10 g per liter of the said composition, which composition is characterized in that it contains, in addition to the perchloroethylene and its appropriate stabilizing agents, at least 0.5% by weight, more generally between about 1 and 10% and preferably from 1.5 to 5% by weight, relative to the said composition, of at least one primary or secondary alcohol of the formula ROH, in which R represents an alkyl or alkenyl radical containing from 4 to 6 carbon atoms, the said alcohol having a boiling point of between 95° and 140° and/or forming, with the perchloroethylene, an azeotrope having a boiling point of between 80° and 130° C.

More precisely, the invention is applied to the use, in the said composition, of at least one of the alcohols represented by the following: butan-1-ol, butan-2-ol, isobutanol, but-3-en-2-ol, 2-methylbutan-1-ol, 3-methylbutan-1-ol, 3-methylbutan-2-ol, 2,2-dimethylpropan-1-ol, 3,3-dimethylbutan-2-ol, pentan-3-ol, pent-1-en-3-ol, pent-4-en-1-ol, 2-methylpentan-2-ol, 3-methylpentan-2-ol, 4-methylpentan-2-ol, hexan-2-ol and hexan-3-ol.

According to a preferred embodiment of the invention, butan-1-ol and/or isobutanol and/or 3-methylbutan-1-ol and/or butan-2-ol are used.

The procedure which makes it possible to evaluate the "greying" of the textiles, uses a soil representative of the soil usually present on clothes and having the following composition by weight:

| | |
|---|---|
| Carpet dust passed throught a 26 mesh sieve (mesh size of 0.63 mm) | 5 |
| Lampblack ground in its own weight of mineral oil | 0.2 |
| Stabilized perchloroethylene | 160 |
| The white textile samples used were as follows: | |
| 100% polyester of 268 g/m$^2$ | |
| 100% polyacrylonitrile of 220 g/m$^2$ | |
| 100% wool of 280 g/m$^2$ | |
| 100% cotton of 110 g/m$^2$. | |

In order to evaluate the "greying" of the textiles, the following were placed successively in a laboratory drum-type machine:

225 cm$^2$ of each of the abovementioned textile samples and 1 liter of the composition based on stabilized perchloroethylene, in which 4 cm$^3$ of the soil defined above had been dispersed.

After a treatment lasting 5 minutes at 25° C., the textiles were spun and dried at 60° C. in a ventilated oven.

Each of the samples treated and more or less "greyed" in this way was subjected to a determination of the reflectance index with the aid of a "Reflectionmeter 670" from the "Photovolt" Company (United States of America), equipped with a green filter.

The apparatus was set at 100 for each untreated original textile and the reflectance of each "greyed" sample was measured. The closer the reflectance is to 100, the lesser the greying.

The following examples illustrate the various aspects of the invention without implying a limitation. The indicated percentages of the constituents of each composition are expressed by weight, relative to the composition in question.

In all the examples, reference is made, by way of a control, to the reflectance index measurements of textile samples treated under the same conditions with stabilized perchloroethylene which does not, however, contain the anti-redeposition agent forming the subject of the present invention.

EXAMPLES 1 TO 12

By following the procedure explained above, the "anti-greying" or anti-redeposition effect of a composition based on initially stabilized perchloroethylene, to which different proportions of various alcohols had been incorporated, was examined.

The starting perchloroethylene was stabilized with 0.0025% of triethylamine, 0.002% of N-methylpyrrole and 0.02% of t-butanol.

The tables below summarize the results obtained.

For each series of examples, these tables include a control experiment carried out with a composition which did not contain any alcohol of the invention.

TABLE I

| Example | Composition | Fibre: Cotton | Wool | Polyester | Polyacrylonitrile |
|---|---|---|---|---|---|
| | Control | 81.5 | 86.5 | 76 | 67 |
| 1 | Perchloroethylene + 2.5% of 3-methylbutan-1-ol | 83 | 89 | 85.5 | 70 |
| 2 | Perchloroethylene + 5% of 3-methylbutan-1-ol | 90.5 | 88.5 | 93.5 | 86 |

TABLE II

| Example | Composition | Fibre: Cotton | Wool | Polyester | Polyacrylonitrile |
|---|---|---|---|---|---|
| | Control | 83.5 | 84.5 | 73 | 63 |
| 3 | Perchloroethylene + 2.5% of butan-1-ol | 82 | 91 | 88 | 75 |
| 4 | Perchloroethylene + 5% of butan-1-ol | 84 | 94 | 93 | 87 |
| | Control | 73 | 77.5 | 57 | 59 |
| 5 | Perchloroethylene + 2.5% of isobutanol | 74 | 84.5 | 75 | 68 |
| 6 | Perchloroethylene + 5% of isobutanol | 81 | 90.5 | 89 | 82.5 |

TABLE III

| Example | Composition | Fibre: Cotton | Wool | Polyester | Polyacrylonitrile |
|---|---|---|---|---|---|
| | Control | 82 | 81.5 | 76.5 | 65 |
| 7 | Perchloroethylene + 5% of butan-2-ol | 83 | 91 | 92 | 81 |

Table IV below shows the cumulative reflectances of the four textile fibres, and also their average, for compositions containing various proportions of isobutanol.

TABLE IV

| Example | Composition | Cumulative reflectance | Average |
|---|---|---|---|
| | Control | 271 | 67.7 |
| 8 | Perchloroethylene + 0.5% of isobutanol | 286 | 71.5 |
| 9 | Perchloroethylene + 1% of isobutanol | 294 | 73.5 |
| 10 | Perchloroethylene + 2.5% of isobutanol | 320 | 80 |
| 11 | Perchloroethylene + 5% of isobutanol | 344 | 86 |
| 12 | Perchloroethylene + 10% of | 349 | 87.2 |

TABLE IV-continued

| Example | Composition | Cumulative reflectance | Average |
|---|---|---|---|
| | isobutanol | | |

We claim:

1. Process for reducing soil redeposition onto textile articles made of natural, synthetic or artificial fibers or blends thereof, during dry cleaning operations using stabilized perchloroethylene, wherein a sufficient amount of at least one primary or secondary alcohol of the formula ROH, in which R represents an alkyl or alkenyl radical containing from 4 to 6 carbon atoms, is incorporated as anti-redeposition adjuvant into this perchloroethylene, said alcohol having a boiling point of between 95° and 140° and forming, with the perchloroethylene, an azeotrope having a boiling point of between 80° and 130° C.

2. Process as claimed in claim 1 in which the amount of the anti-redeposition adjuvant incorporated into the perchloroethylene is at least 0.5% by weight.

3. Process as claimed in claim 1 in which the amount of the anti-redeposition adjuvant incorporated into the perchloroethylene is within the range of 1–10% by weight.

4. Process as claimed in claim 1 in which the anti-redeposition adjuvant incorporated into the perchloroethylene is within the range of 1.5–5% by weight of the perchloroethylene.

5. Process as claimed in claim 1 in which the adjuvant is selected from the group consisting of butan-1-ol, butan-2-ol, isobutanol and 3-methylbutan-1-ol and mixtures thereof.

6. Anti-redeposition dry cleaning composition consisting essentially of stabilized perchloroethylene containing up to 6% by weight of water, relative to the textiles to be treated, and customary additives in an amount of 1 to 10 g additive per liter of the said composition, and at least 0.5% by weight of at least one primary or secondary alcohol of the formula ROH, in which R represents an alkyl or alkenyl radical containing from 4 to 6 carbon atoms, said alcohol having a boiling point of between 95° and 140° and forming, with the perchloroethylene, an azeotrope having a boiling point of between 80° and 130° C.

7. Composition as claimed in claim 6 in which the alcohol is present in an amount within the range of about 1 and 10% by weight.

8. Composition as claimed in claim 6 in which the alcohol is present in an amount within the range of 1.5 to 5% by weight.

9. Composition as claimed in claim 6 in which the alcohol is selected from the group consisting of butan-1-ol, butan-2-ol, isobutanol and 3-methylbutan-1-ol and mixtures thereof.

* * * * *